US005165618A

United States Patent [19]

Ruff

[11] Patent Number: 5,165,618

[45] Date of Patent: Nov. 24, 1992

[54] WINDING MACHINE FOR PAPER WEB

[75] Inventor: Hans-Albrecht Ruff, Heidenheim, Fed. Rep. of Germany

[73] Assignee: J. M. Voith GmbH, Heidenheim, Fed. Rep. of Germany

[21] Appl. No.: 642,178

[22] Filed: Jan. 17, 1991

Related U.S. Application Data

[63] Continuation of Ser. No. 412,502, Sep. 26, 1989, abandoned.

[30] Foreign Application Priority Data

Sep. 26, 1988 [DE] Fed. Rep. of Germany ..... 3832601

[51] Int. Cl.[5] ..... B65H 35/02

[52] U.S. Cl. ..... 242/56.4

[58] Field of Search ..... 242/56.4, 65, 66

[56] References Cited

U.S. PATENT DOCUMENTS

| | | | |
|---|---|---|---|
| 3,949,948 | 4/1976 | Tomma | 242/65 X |
| 4,000,863 | 1/1977 | Straujups | 242/56 R |
| 4,508,283 | 4/1985 | Beisswanger | 242/56.4 |
| 4,550,887 | 11/1985 | Schonmeier | 242/65 X |
| 4,728,049 | 3/1988 | Veith et al. | 242/66 X |
| 4,732,341 | 3/1988 | Ruff | 242/66 X |
| 4,749,140 | 6/1988 | Ruff | 242/66 X |
| 4,893,762 | 1/1990 | Kuhn | 242/65 X |

FOREIGN PATENT DOCUMENTS

| | | |
|---|---|---|
| 2147673 | 8/1976 | Fed. Rep. of Germany . |
| 60-157441 | 8/1985 | Japan . |

*Primary Examiner*—Daniel P. Stodola
*Assistant Examiner*—John P. Darling
*Attorney, Agent, or Firm*—Baker & Daniels

[57] ABSTRACT

A winding machine with receiving stations for winding rolls arranged on both sides of a roller, to which web-form material runs alternately (as viewed in machine transverse direction). On a machine frame there are arranged axially unslidable load rollers following one upon another over the usable machine width. The load rollers are movable with operating arrangement against the winding rolls. For the use of the load rollers it is merely required that there be selected those rollers which lie within the width of the corresponding web strip.

1 Claim, 1 Drawing Sheet

WINDING MACHINE FOR PAPER WEB

This is a continuation of application Ser. No. 07/412,502, filed Sep. 26, 1989, now abandoned.

BACKGROUND OF THE INVENTION

The invention relates to a winding machine for web-form material, particularly paper.

From German published application DE-AS 20 60 758 there is known a winding machine with a supporting roller in which winding rolls lying on the supporting roller diametrically opposite one another in a horizontal plane are each supported in a respective receiving station. The winding rolls are guided on both ends by guide slides of the receiving stations engaging in their cores. A pair of load rollers is allocated to each winding roll, the roller length of which is less than the winding roll width, so that the load rollers in engagement on the winding roll circumference will not collide with the guide slides of the receiving stations. The load roller pairs are borne on swinging levers about an axis running parallel to the supporting roller longitudinal axis. On this axis the swinging levers are slidably guided in transverse direction to the machine, in order to make it possible to adjust the load roller pairs to changing winding roll widths. This adjustment must be made manually by the machine personnel. It is possible that, because of inexact positioning, the load rollers will collide with the guide slides of the receiving stations.

SUMMARY OF THE INVENTION

Underlying the present invention is the problem of avoiding the expenditure of effort required to adjust the positioning of the load rollers.

The solution presented herein is advantageous since among the load rollers arranged over the entire usable machine width only those have to be selected which lie with their shell in the winding roll or strip width. The positioning work of the machine personnel is therefore eliminated. With the solution according to the invention a larger number of load rollers are necessary over the machine width than in the case of the known state of development. On the other hand, however, the necessity of thrust guidance for the load rollers is eliminated.

In accordance with another aspect of the invention, at least one roller encounters along its entire length a winding roll of even the smallest width, despite the axially unshiftable arrangement of the load rollers. It is uncritical if this roller engages on the winding roll unsymmetrically with respect to the transverse axis of the winding roll.

In yet a further aspect of the present invention, the selection of the load rollers is controlled in dependence on the position of the separating arrangements, so that selection errors by the personnel are excluded.

A preferred embodiment of the invention is explained in detail below with the aid of the drawing.

DESCRIPTION OF THE PREFERRED EMBODIMENT

Figure 1:
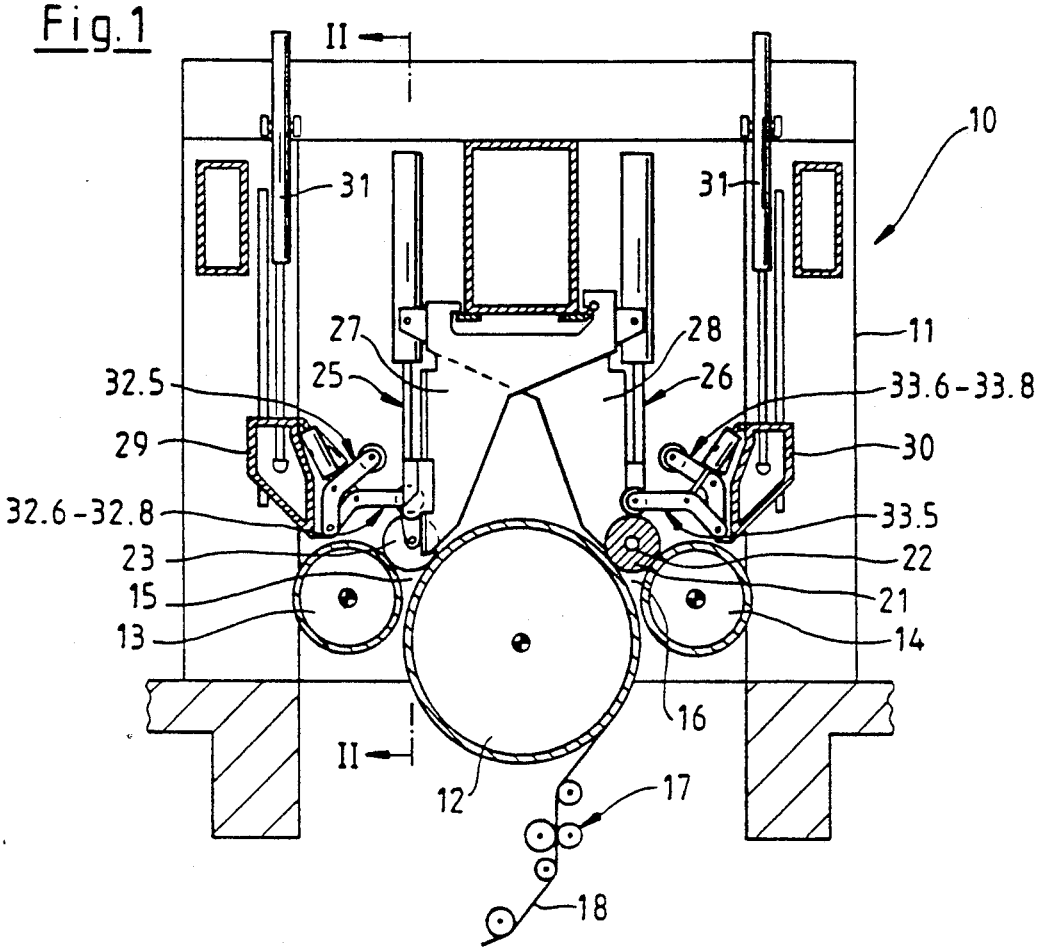
FIG. 1 shows a section through a simplified winding machine represented along the line I—I in FIG. 2.
Figure 2:
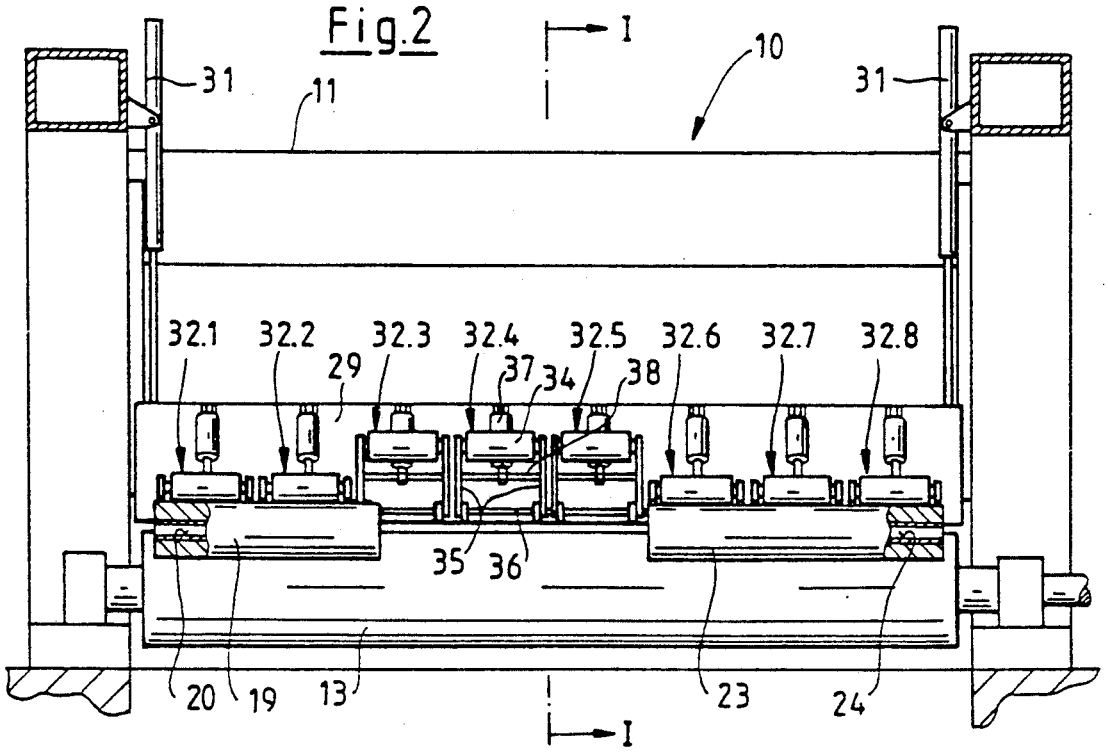
FIG. 2 shows a section through the machine along the line II—II in FIG. 1.

The winding machine 10 presents carrying rollers arranged parallel adjacently in its machine frame 11, and, namely, a central roller 12 of large diameter as well as one outer carrying roller 13 and 14 each, of smaller diameter (FIG. 1). The carrying rollers 12 and 13 form in their upper spandrel a winding bed 15. The rollers 12 and 14 form a winding bed 16. Underneath the central carrying roller 12 there is arranged a cutting mechanism 17, in which an incoming paper web 18 is longitudinally divided into three web strips. The first web strip (counting in the direction from left to right in FIG. 2) is wound in the winding bed 15 onto a first winding roll 19 with a core 24 in the winding bed 15. The web strips running reciprocally into the two winding beds (15 and 16) (as viewed in transverse direction of the machine) have different widths. Depending on the requirements of the user, the paper strip width or format changes and the width of the winding rolls generated changes therewith.

The winding rolls 19, 21 and 23 are held in their respective winding bed 15 or 16 in receiving stations 25 and 26. In particular, (insofar as evident from the drawing) the winding roll 23 is held by winding blocks 27 allocated to the two face sides of the receiving station 25 and the winding roll 21 is held by winding blocks 28 of the receiving station 26. The winding blocks 27 and 28 are adjustable to the position and width of the paper web strips or of the winding rolls 19, 21 and 23 in the winding beds 15 and 16. The winding blocks grip with tension heads (not represented) on both ends into the cores 20, 22 and 24 of the winding rolls 19, 21 and 23 and guide these during the winding process.

The machine frame 11 of the winding machine 10 is equipped with traverses 29 and 30 running in transverse direction of the machine, each being allocated to one of the winding beds 15 and 16. The traverses 29 and 30 are slidably guided in vertical direction in the machine frame 11. For their operation there are provided hydraulic thrust motors 31 which involve a piston-cylinder arrangement. The traverses 29 and 30 are movable with the thrust motors 31 into a lower position (represented in the drawing) as well as into an upper position, in which latter position they are situated above the greatest winding rolls which can be generated in the winding machine 10.

Each traverse 29 or 30 is equipped with a series of eight load rollers 32.1 to 32.8 or 33.5 to 33.8, respectively (insofar as visible in the drawing). The load rollers are arranged successively over the useful machine width and are axially unshiftable on the traverses 29 and 30. The similarly constructed load rollers have a roller body 34 which is borne on both face sides by swingable levers 35 on an axis 36 of the traverse 29 or 30. For their operation the load rollers are provided with a hydraulic thrust motor 37 each, which engages, on the one hand, on a transverse crosspiece 38 connecting the two levers 35, and, on the other hand, is supported on the traverse 29 or 30, respectively. With the thrust motor 37 the respective load roller is swingable with respect to the corresponding winding bed 15 or 16.

At the beginning of winding the load roller with its roller body 34 running parallel to the corresponding core is placed on top of the corresponding core. For example, the load roller 33.5 is placed on the core socket 22 in the winding bed 16. A line pressure of predetermined magnitude is exerted by the thrust motor 37 on the core in order to avoid its bending in the initial phase of the winding process and to generate a hard core winding. In the course of the winding process the load roller follows with the winding roll increasing in diameter. The corresponding line pressure is dimensioned in dependence on the desired winding hardness. At a certain winding roller diameter the load roller 33.5 is lifted off from the winding roll 21 and the traverse 30 is moved with the thrust motors 31 into its upper end position.

The length of the load roller bodies 34 amounts preferably to less than half of the smallest winding roll width to be produced in the winding machine 10. Hereby it is assured that with such a roll width at least one load roller can swing into position between the two winding blocks of the corresponding receiving station and guide the winding roll without danger of collision with the winding blocks. In dependence on the width of the paper web strips as well as their position in the particular winding bed, these are in the preferred embodiment represented by the load rollers 32.1 and 32.2 as well as 32.6, 32.7 and 32.8 allocated to the winding bed 15, which rollers can be selected for the engagement on the winding rolls 19 and 23. The load rollers 32.3 to 32.5 remain, however, in their position turned away from the winding bed 15. The selection of the load rollers in the winding bed 16 is a corresponding one.

This selection can be made by the machine personnel by hand. The selection is to be corrected on a change of the web strip width. The selection can also be carried out by a machine control system for the positioning of the arrangements forming the cutting mechanism 17 for the separating of the paper web 18 into strips. In this case the machine control activates the corresponding thrust motors of the load rollers that lie within the width of the corresponding strip.

Load rollers arranged axially unslidable in succession over the useful machine width can also be used in winding machines of the type having one support-roller. Since the winding rolls are supported exclusively on one roller (corresponding analogously to the central carrying roller 12 in the preferred embodiment) it is required that the load rollers be equipped with two adjacently lying roller bodies, so that the cores or the winding rollers being built up will be securely guided.

What is claimed is:

1. A winding machine having a machine width useful for winding a paper web cut into strips, said machine comprising:

a machine frame;

a carrying roller rotatably mounted to said machine frame;

means for separating said paper web into strips;

a pair of receiving stations arranged one on each side of said carrying roller, each of said receiving stations receiving a winding roll on which is wound alternate strips of the paper web as viewed in transverse direction of the machine;

a pair of load roller means borne on said machine frame, each associated with a respective one of said pair of receiving stations and movable toward a respective winding roll, for pressing the winding roll against said carrying roller;

actuating means for moving each load roller means toward the respective winding roll;

said load roller means including a plurality of load rollers axially arranged over the useful machine width and being nonshiftable in axial direction, each of said load rollers having an axial length less than half the width of the paper strip pertaining thereto, the load rollers being arranged without any substantial gap between two neighbored load rollers; and means for selectively activating said load rollers which lie within the width of the corresponding strip.

* * * * *